US005271197A

United States Patent [19]

Uno et al.

[11] Patent Number: 5,271,197

[45] Date of Patent: Dec. 21, 1993

[54] EARTHQUAKE RESISTANT MULTI-STORY BUILDING

[75] Inventors: Toshio Uno; Yoshitaka Yabe; Kiyoshi Ikura; Shinji Mase; Toshihiko Hirama; Hideo Shimizu, all of Tokyo; Masahiro Kato, Kashiwa; Fumio Ohtake, Kashima; Takehiko Terada; Tomomi Kanemitsu, both of Tokyo, all of Japan

[73] Assignees: Shimizu Construction Co., Ltd., Tokyo; Sumitomo Metal Industries, Ltd., Osaka, both of Japan

[21] Appl. No.: 928,080

[22] Filed: Aug. 13, 1992

Related U.S. Application Data

[63] Continuation of Ser. No. 543,126, Aug. 6, 1990, abandoned, which is a continuation-in-part of Ser. No. 376,922, Jul. 10, 1989, abandoned, which is a continuation of Ser. No. 101,663, Sep. 28, 1987, abandoned.

[30] Foreign Application Priority Data

| | | | |
|---|---|---|---|
| Sep. 26, 1986 | [JP] | Japan | 61-227781 |
| Sep. 30, 1986 | [JP] | Japan | 61-231689 |
| Jun. 23, 1989 | [JP] | Japan | 1-161873 |
| Jun. 23, 1989 | [JP] | Japan | 1-161874 |

[51] Int. Cl.[5] ..... E04H 9/02

[52] U.S. Cl. ..... 52/167 R

[58] Field of Search ..... 52/167 R, 294, 729

[56] References Cited

U.S. PATENT DOCUMENTS 3,638,377 2/1972 Caspe .

4,991,366 2/1991 Teramuro et al. .

OTHER PUBLICATIONS

"Earthquake-Resistant Limit State Design for Buildings" by Hiroshi Akiyama (University of Tokyo Press) 1985 Architecture—Sep. 1983 pp. 74–76.

*Primary Examiner*—Carl D. Friedman

*Assistant Examiner*—Creighton Smith

*Attorney, Agent, or Firm*—Cushman, Darby & Cushman

[57] ABSTRACT

The present invention provides an earthquake resistant multi-story building which is characterized by having an energy concentration story. The energy concentration story has an elasto-plastic force-displacement relationship regarding horizontal force and displacement. The force-displacement relationship is characterized in that: (a) stiffness in elastic range ($F_y/d_y$) is generally equal to an optimal stiffness of the same story according to an elastic design concept; (b) the yield strength $F_y$ is generally less than 80% of an optimum yield strength; (c) stiffness in plastic range is positive and generally less than about a half of the stiffness in the elastic range; and (d) ultimate displacement is generally at least twice as large as the yield displacement. The energy concentration story is capable of entering into the plastic range while other stories are in the elastic range, and absorbing vibration energy by plastic deformations thereof so as to decrease deformations of other stories when a large external force is exerted to the building.

13 Claims, 19 Drawing Sheets

EARTHQUAKE RESISTANT MULTI-STORY BUILDING

This is a continuation of application Ser. No. 07/543,126, filed on Aug. 6, 1990 now abandoned, which was a continuation-in-part of Ser. No. 07/376,922, filed Jul. 10, 1989 now abandoned which was a continuation of Ser. No. 07/101,663 filed Sep. 28, 1987 abandoned upon the filing hereof.

BACKGROUND OF THE INVENTION

The present invention relates to earthquake resistant multi-story buildings which exhibit an excellent earthquake resistance behavior.

Buildings have been designed according to an elastic design concept which requires that the stress of structural members of buildings should be lower than a predetermined value which is within the elastic range against design loads such as earthquakes. It is required, according to an elastic design concept, that the maximum stress should be within the elastic range and less than a predetermined magnitude against earthquakes of medium size which the building may experience relatively frequently; and less than the yield stress against ultimate earthquakes which the building may experience. In other words, conventional design concepts do not allow the structural members of buildings to enter into the plastic range.

On the other hand, there is a method called the limit state design. The method is capable of analyzing the seismic behavior of buildings over the elastic range by taking into account the sequential yielding of structural members during earthquakes. Akiyama has proposed in his literature "Earthquake Resistant Limit State Design for Buildings", University of Tokyo Press, that when a story of a multi-story building enters into plastic range and the story has hysteretic characteristics regarding the force-displacement relationship, the story absorbs the vibrational energy during earthquakes and thus reduces the deformation of other stories. Akiyama provides, in the book, schematic concepts of buildings which have the elasto-plastic force-displacement relationship. Although, the literature of Akiyama provides only general idea of a type of earthquake resistant building and does not provide an actual structure or force-displacement relationship which functions as theoretically expected.

SUMMARY OF THE INVENTION

It is therefore an object of the present invention to provide a multi-story earthquake resistant building which has at least one energy concentration story for absorbing vibrational energy thereby reducing displacement of other stories. The energy concentration story has an elasto-plastic force-displacement relationship which exhibits an elastic behavior while the displacement is smaller than a predetermined displacement, that is, the yield displacement; and a plastic behavior accompanied by the stiffness degradation when the displacement exceeds the yield displacement. Therefore, the energy concentration story exhibits an elastic behavior within the elastic range similar to buildings designed according to conventional elastic design concept. Once the displacement exceeds the yield displacement, which may occur during stronger earthquakes, the story exhibits a hysteretic behavior and absorbs vibrational energy. The force-displacement relationship which exhibits elasto-plastic characteristics is generally specified by the yield strength $F_y$, the yield displacement $d_y$, the ultimate strength $F_u$, and the ultimate displacement $d_u$. The stiffness in the elastic range $k_1$ and the stiffness in the plastic range $k_2$ are defined by using the above definitions as follows:

$$k_1 = F_y/d_y \quad (1)$$

$$k_2 = (F_u - F_y)/(d_u - d_y) \quad (2)$$

A story may comprise elastic deformation members and plastic deformation members of which the force-displacement relationship is typically shown in FIG. 16. The yield strength and yield deformation of the elastic deformation members are ${}_fQ_y$ and ${}_f\delta_y$, respectively; the yield strength and yield displacement of the plastic deformation members are ${}_sQ_y$ and ${}_s\delta_y$ respectively. The elastic deformation members and plastic deformation members typically correspond to long thick columns and short thin columns, respectively. The yield strength of the story $F_y$ is the restoring face of the story when the plastic deformation members yield, that is, a sum of the yield strength of plastic deformation members ${}_sQ_y$ and the restoring force of the elastic deformation members at the same displacement. The ultimate strength of the story $F_u$ is a sum of the yield strength of the elastic deformation members and the restoring force of the plastic deformation members at the yield displacement of the elastic deformation members. Therefore, the ultimate strength of the story $F_u$ is expressed as $F_u = {}_fQ_y + {}_sQ_y$.

According to an aspect of the present invention, there is provided a multi-story earthquake resistant building which comprises at least one energy concentration story. The energy concentration story has an elasto-plastic force-displacement relationship regarding horizontal force and displacement. The force-displacement relationship of the energy concentration story is characterized in that:

(a) the stiffness in the elastic range ($k_1$) is generally equal to an optimal stiffness of the same story according to an elastic design concept;

(b) the ultimate strength $F_u$ is generally between about 0.5 and about 0.8 times the optimum strength;

(c) the ultimate strength $F_u$ is not smaller than the yield strength $F_y$; and (d) ultimate displacement is generally at least eight times as large as the yield displacement. By virtue of the characteristics mentioned above, the energy concentration story enters into the plastic range while other stories are in the elastic range, and absorbs vibration energy by plastic deformations thereof so as to decrease deformation of other stories when a large seismic force is exerted on the building.

Other aspects of the present invention will also become clear by the following description and attached drawings.

DETAILED DESCRIPTION OF PREFERRED EMBODIMENTS

Figure 14:
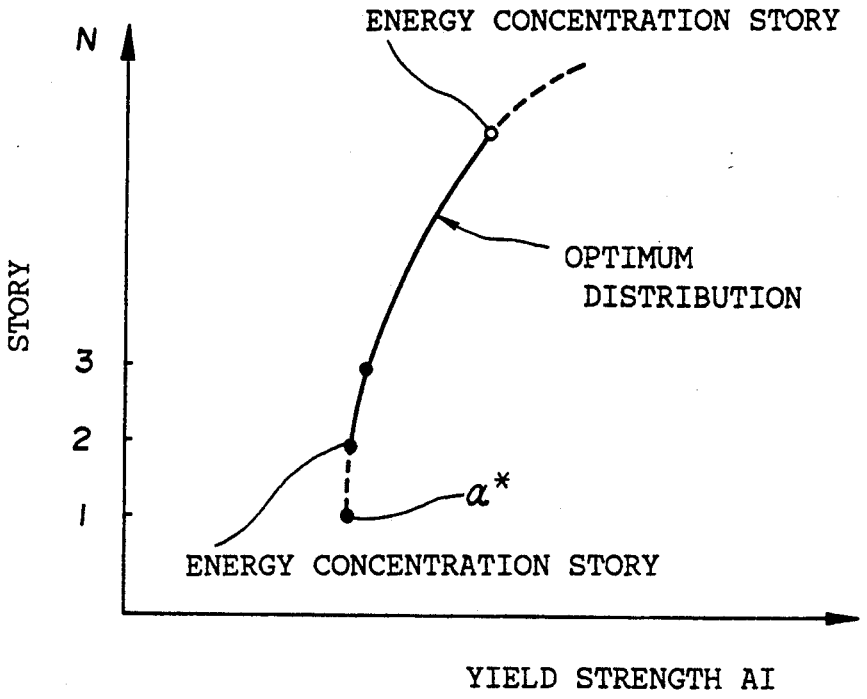
FIG. 14 is a diagram showing optimum yield strength of stories and yield strength of energy concentration stories.
Figure 15:
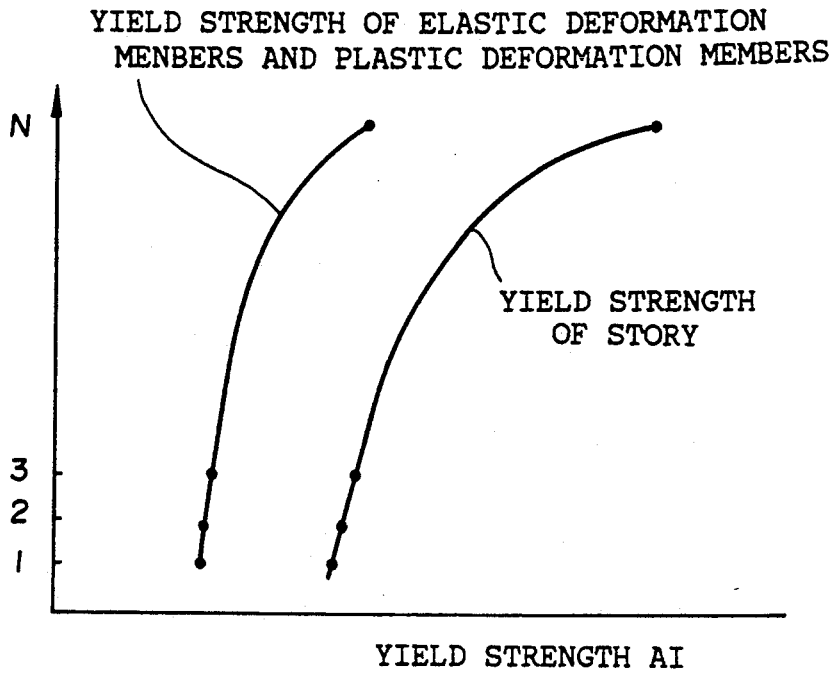
FIG. 15 is a diagram showing yield strength of stories and yield strength of elastic deformation members of stories.

When each story of a building has an elasto-plastic force displacement relationship regarding the horizontal force and displacement, and the building is subjected to an earthquake, the building deforms and vibrates within an elastic range when the earthquake ground motion is relatively small. When the earthquake ground motion is larger than a certain level, the building enters into a plastic deformation range. Normally, one story enters into the plastic deformation range prior to other stories, and other stories enter into the plastic deformation range as the ground motion continues or increases. When considering the elasto-plastic seismic behavior of a building, yield strength is an index among others such as yield displacement, stiffness degradation ratio, etc. FIG. 14 shows optimum yield strength of the floors. When yield strengths of floors have the values as shown in FIG. 14, the seismic damages of the floor are generally identical to one another. The seismic damage is defined as the maximum displacement the subjective floor experiences divided by the yield displacement of the floor. According to "Earthquake Resistant Limit State Design for Buildings", University of Tokyo Press, the optimum yield strength of floors are determined as follows:

$$a_i = f((i-1)/N) \tag{3}$$

$$f(x) = 1 + 1.5927x - 11.8519x^2 + 42.5833x^3 - 59.4827x^4 + 30.1586x^5 \tag{4}$$

wherein N is the number of stories of the building, and $a_i$ is the yield shear force coefficient which is the ratio of yield strength of a story and the weight supported by the story.

When the yield strength of a certain floor is lower than the optimum level and those of other floors are at the optimum level, the floor having the lower yield strength enters into the plastic deformation range prior to other floors, and the seismic damage is concentrated on that floor. When the yield strength of the floor is less than 80% of the optimum level, the energy concentration to the floor becomes distinct.

When the seismic behavior of a building is to be considered, two earthquakes, namely an intermediate earthquake and an ultimate earthquake, are taken into account. The intermediate earthquake is an earthquake which the building may experience at least a few times during the service period of the building. The ultimate earthquake is the strongest earthquake possible for the building to experience during its service period. A building is designed so that each of the stories remains within a predetermined elastic stress level during the design earthquake, and may enter into the plastic deformation range but does not exceed the ultimate displacement during the ultimate earthquake. By virtue of the design concept mentioned above which is applied in the present invention, it has become possible to take into account in a more realistic way the entire ability of a building to resist earthquakes.

It has been theoretically shown by Akiyama that when the yield strengths except for the first story are "a" times higher than the above-mentioned optimum distribution, and the first story has the optimum yield strength, more than about 95% of the vibration energy is concentrated on the first story. The coefficient "a" is described as follows:

$$a = 1.2 \tag{5}$$

when $0.5 < a_1/a_{e1} < 1.0$ $$a = 1.8 - 1.2(a_1/a_{e1}) \tag{6}$$

when $a_1/a_{e1} < 0.5$

The inventors have found that when the yield strength of the first story is less than 80% of the optimal level, a substantial portion of the vibrational energy is concentrated at the first story. In such a case, the first story is called the energy concentration story because a substantial part of the vibrational energy is concentrated and consumed at that story. When the yield strength is less than 50%, the concentration is further distinct. When the energy concentration story is located at a plurality of stories, the effect to concentrate the vibrational energy thereto is more apparent. One of the combinations of stories wherein the energy concentration is effective is to locate the energy concentration stories at the first floor and the top floor. The ground floor will be called a first floor hereinafter throughout the specification and the claims.

The elasto-plastic force-displacement relationship of the energy-concentration story is practically provided by two sort of structural members, one is the plastic deformation members and the other is the elastic deformation members. The plastic deformation members are relatively short compared to the other and permit smaller elastic deformation. The plastic deformation members permit a large plastic deformation beyond the elastic deformation range and also repeated deformation. High tension steels are suitably used for the plastic deformation members because the high tension steel exhibits the above-mentioned features of the plastic deformation members. The elastic deformation members are longer than the others and thus permit a large elastic deformation. The elastic deformation members may or may not yield before the ultimate displacement. Ordinary steel material can be used for the elastic deformation members. The plastic deformation members have a higher elastic stiffness than the elastic deformation members. The elastic deformation members and the plastic deformation members are connected to each other so that their displacements are generally identical to the displacement of the story.

Figure 16:
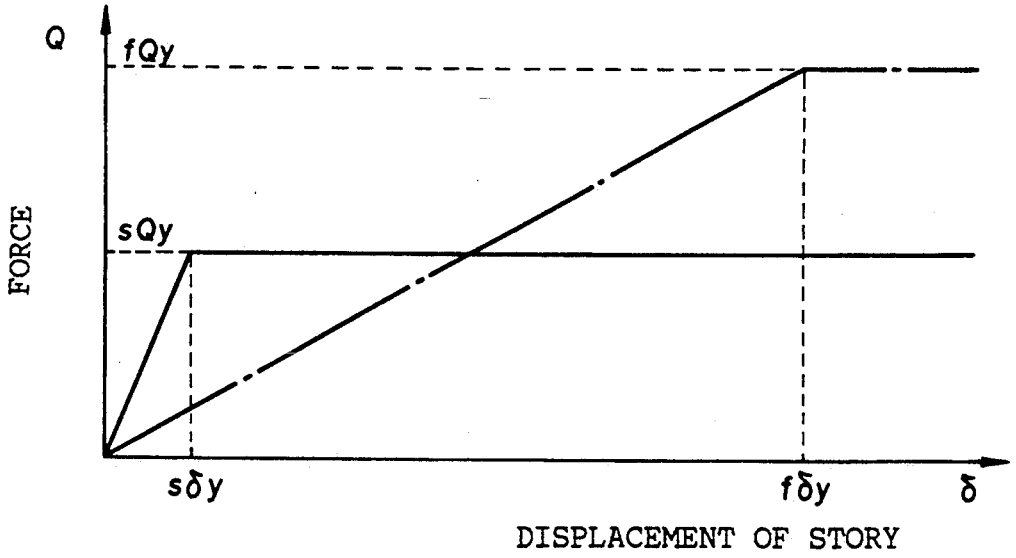
FIG. 16 shows force-displacement relationships of the elastic deformation members and plastic deformation members.

FIG. 16 shows force-displacement relationships of elastic deformation members and plastic deformation members. Both members have elasto-plastic force-displacement relationships. The elastic deformation members have a relatively large elastic deformation range and the plastic deformation members have a relatively small elastic deformation range.

Figure 1:
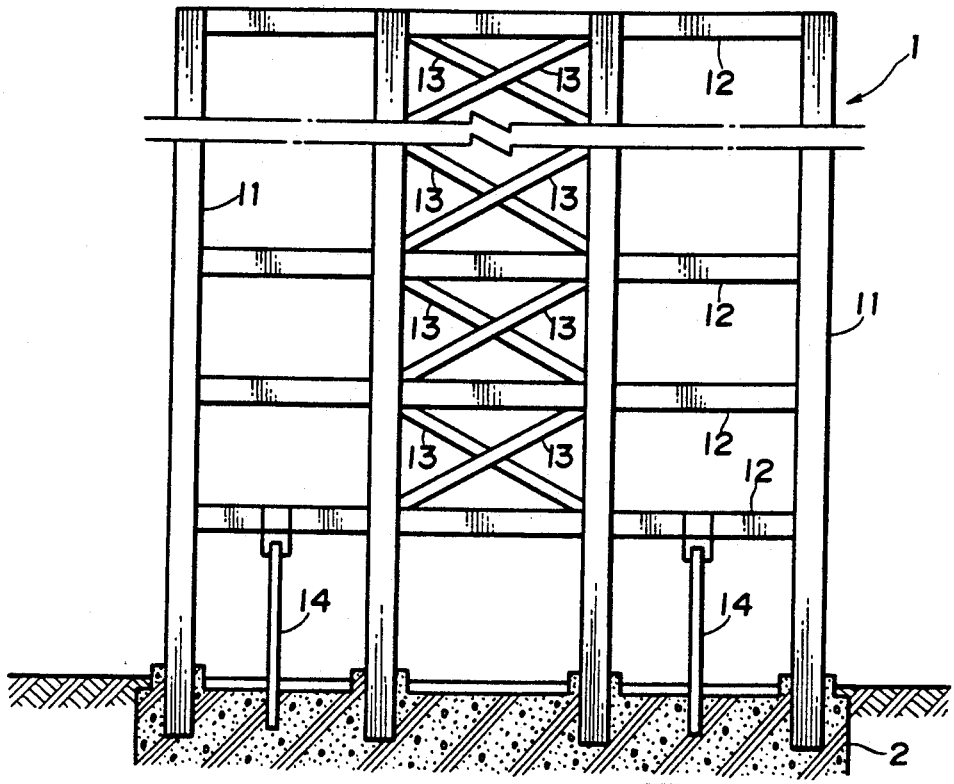
FIG. 1 shows a framework of an earthquake resistant building according to an embodiment of the present invention.
Figure 2:
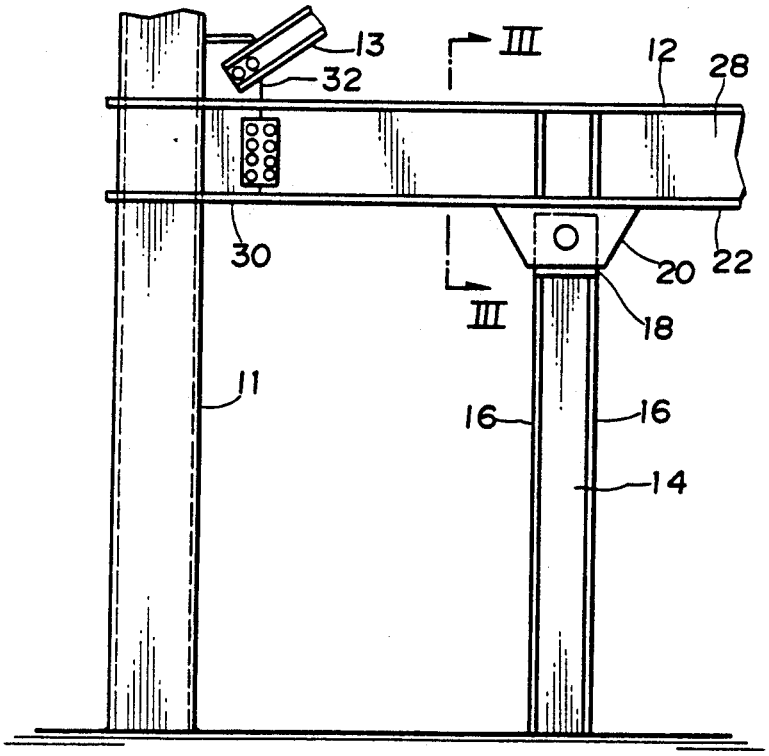
FIGS. 2 and 3 show enlarged details of the energy concentration story of the earthquake resistant building shown in FIG. 1.
Figure 3:
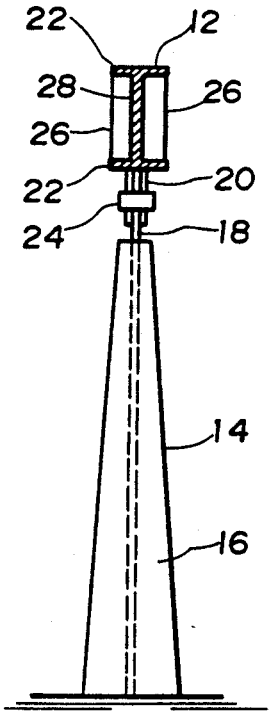

Referring to FIGS. 1 to 3, an earthquake-resistant multi-story building according to the present invention includes a steel framework 1 erected on a foundation 2. The framework 1 includes rectangular steel tube columns 11 as vertical elements, I-steel beams 12, joined at their opposite ends to columns 11, as horizontal elements, and I- or channel steel braces 13 diagonally connecting joint portions thereof together. The first story of the framework includes no brace but has vertical plastic deformation members 14. Each plastic deformation element has its upper end joined to the beam 12 of that story, as the upper horizontal element, and its lower end embedded in the concrete foundation 2, as the lower horizontal element in a conventional manner. The lower end of each plastic deformation element 14 may be anchored to the foundation 2 with anchor bolts. Each plastic deformation member 14 has an I-shaped horizontal cross-selection and its flanges 16 and 16 taper upwards. The upper end of each plastic deformation member 14 has an attachment plate 18 integrally joined to it and the corresponding beam 12 has a pair of parallel brackets 20 and 20 joined to the lower face of its lower flange 22 to project downwards for attaching the attachment plate 18 of each plastic deformation element 14. Each plastic deformation member 14 is sandwiched at its attachment plate 18 between the bracket pair 20 and 20 and joined to the latter with a pin 24. The beam 12 of the first story has a pair of stiffeners 26 and 26 welded to its web 28 and flanges 22 and 22 at a portion corresponding to each bracket pair 20 and 20 to reinforce it. In FIG. 2, reference numerals 30 and 32 designate a bracket for jointing the column 11 and the beam 12 together and a gusset plate for joining the column 11 and the brace 13.

The elements 11 and elements 12, including plastic deformation members 14, of the building are selected in physical properties and cross-sectional shape so that stresses generated in them due to an earthquake may be within an allowable stress unit, the earthquake being expected to occur several times during the life of the building. The plastic deformation members 14 which partly constitute the framework of the first story are also selected in properties and cross-sectional shapes so that they may yield under the severest earthquake which is expected to occur during the building life. The elastic deformation members 11 are selected by properties and cross-sectional shapes so that they may hold in the elastic region even under the severest earthquake. That is, the absence of the braces 13 in the first story provides a difference in strength of the first story compared with the other stories. When an external force is applied to the building due to an earthquake or the like, energy from the external force is hence concentrated at the first story.

When a medium scale earthquake occurs, each element of the building framework deforms in its elastic area as designed in the conventional elastic design method. When a heavy earthquake occurs, the vertical elements 14 in the first story yield, thereby absorbing a large part of the energy of the external force as plastic strain energy of the first story, resulting in a reduction of the energy transmitted to the other stories. Thus, elements of the other stories may have relatively small rigidity and it is therefore possible to reduce the weight of the steel members. It is easy to estimate the amount of energy absorption of the building since the external force energy is concentrated at one portion. Further, latitude in the structural design requirements except the first story increases since it is not necessary to make all the stories plastically deformable as in the conventional limit-state design method. Each elastic deformation element 11, which has a larger elastic deformation capacity as compared to the plastic deformation members 14 keeps it elasticity under such a severe earthquake and thus restrains an increases in each of both the maximum deformation and the residual deformation of the energy concentrated story. Further, the elastic deformation members 11 provide restoring force to the building and hence prevent deterioration of the building due to P-$\delta$ effect. Therefore, the elastic deformation members are made of high strength steel. The P-$\delta$ effect is an apparent reduction of effective restoring force of a story caused by the bending moment exerted on the columns. The bending moment occurs due to the axial force acting on the columns and the horizontal diaplacement of the columns caused by the horizontal force. When horizontal displacement occurs, for example due to an earthquake, the gravity force causes the P-o effect, and the restoring force of the story is inevitably reduced.

The plastic deformation members 14 may be provided to the basement, the second story or the highest story in addition to the first story in a similar manner. For providing each plastic member 14 to the second or the highest story, it is pin joined at its upper end to the upper beam 12, as the upper horizontal element, of two vertically adjacent beams 12 and 12 and at its lower end to the lower beam 12 as the lower horizontal element.

Figure 4:
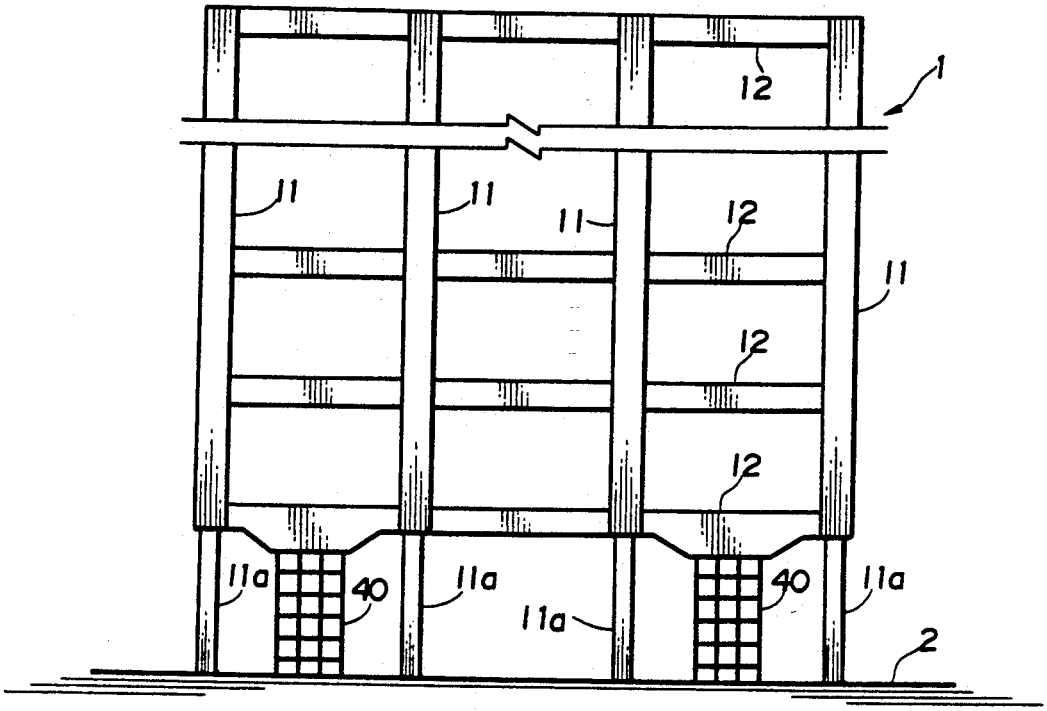
FIG. 4 shows a framework of an earthquake resistant building according to another embodiment of the present invention.
Figure 5:
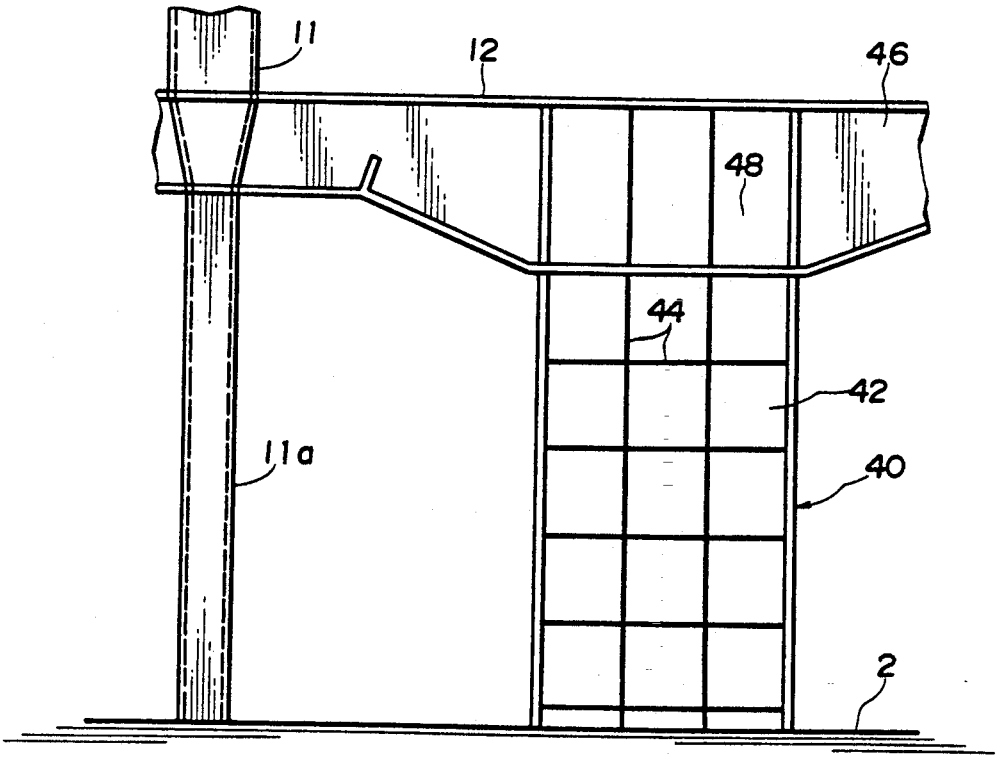
FIG. 5 shows the energy concentration story of the embodiment shown in FIG. 4 in more detail.

FIGS. 4 and 5 illustrate a second embodiment of the present invention, which embodiment is distinct from the preceding embodiment in the first story, in which each of the columns 15 is reduced in outer diameter to form a reduced diameter portion 11*a*, and in that earthquake resistant steel panels 40 are provided instead of the elastic elements 14. The bottom portion of each panel 40 may be anchored to the foundation 2 with anchor bolts. Each of the steel panels 40 has an I-shaped horizontal cross-section and the wide web 42 thereof has a stiffener 44 welded to it in the shape of a lattice. The beam 12 of this story has a web 46 which is broader at steel panel welded portions 48 than at other portions.

In this embodiment, each column 11*a* has a smaller cross-sectional area at the first story than at the other stories and hence there is a difference in strength of the first story form the other stories. Thus, energy form the external force is adapted to concentrate at the first story. The smaller diameter portion 11*a* of each tubular column 11 is relatively strong against axial force and bending moment and the steel walls 40 are more rigid than the smaller diameter portions 11*a* of the columns 11. Thus, the smaller diameter portions 11*a* serve as the elastic deformation members which are made of high strength steel, while the steel panels 40 as the plastic deformation members which are made of ordinary steel.

In the second embodiment, the steel panels 40 are adapted to absorb a large part of energy due to an earthquake and reduce energy to be transmitted to the other stories of the building.

Also in this embodiment, the earthquake energy absorbing structure may be provided at the basement, the second story or the highest story in addition to the first story as in the first embodiment.

Figure 6:
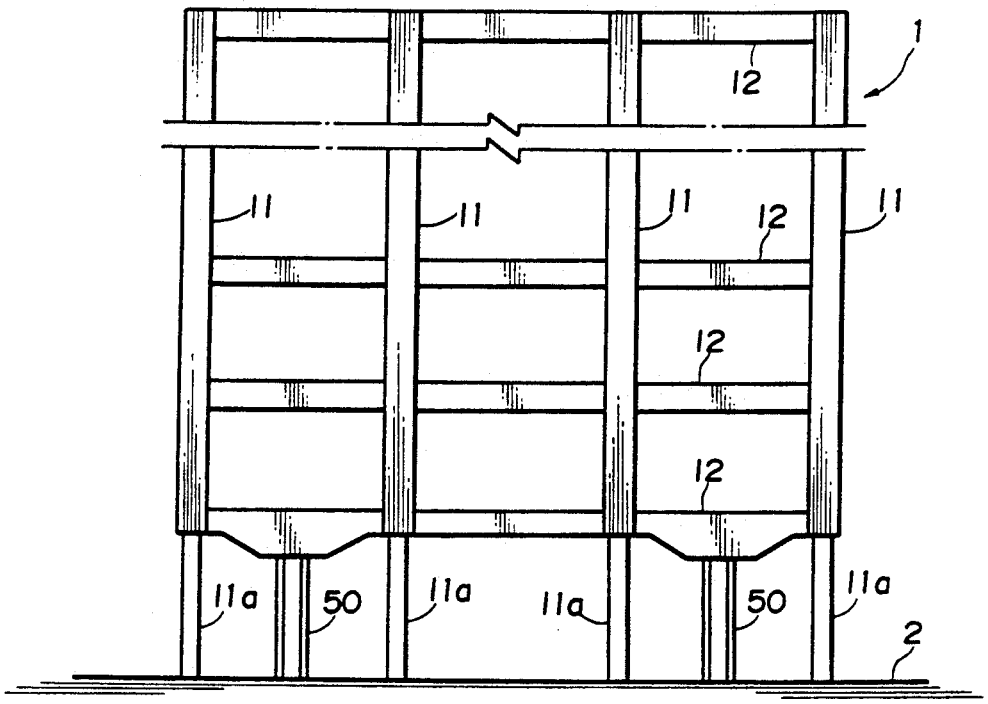
FIGS. 6 and 7 show another embodiment of the present invention.
Figure 7:
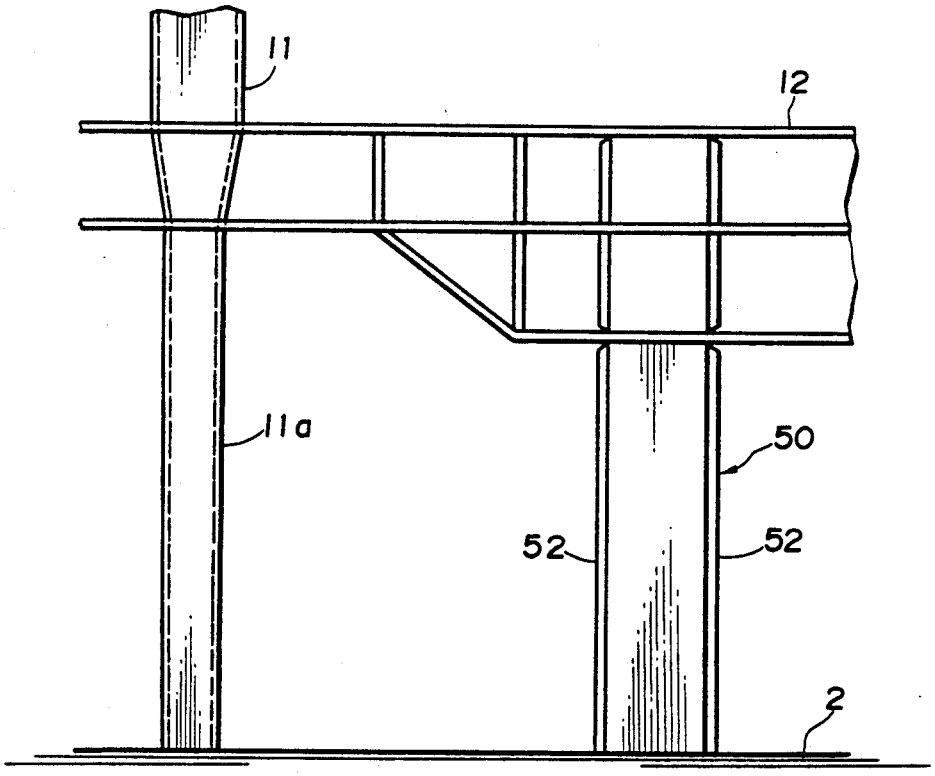

A modified form of the earthquake resistant building structure in FIGS. 4 and 5 is illustrated in FIGS. 6 and 7, in which steel studs 50 are used instead of the steel panels 40. The studs 50 have a substantially I-shaped horizontal cross-section with a pair of flanges 52 laterally projecting. Also, in this modification, the reduced diameter portions 11*a* of the columns 11 serve as the elastic deformation members which are made of high strength steel, while the studs 50 as the plastic deformation members, which are made of ordinary steel to absorb a large part of the earthquake energy.

Figure 8:
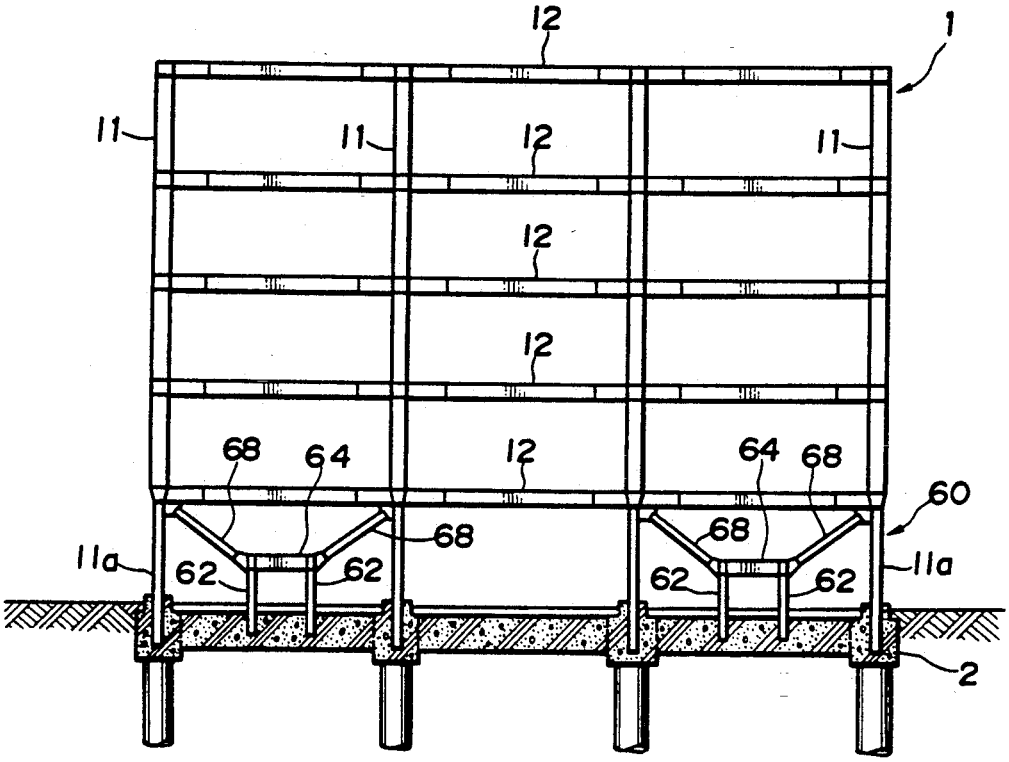
FIG. 8 shows a framework of an embodiment according to the present invention.
Figure 9:
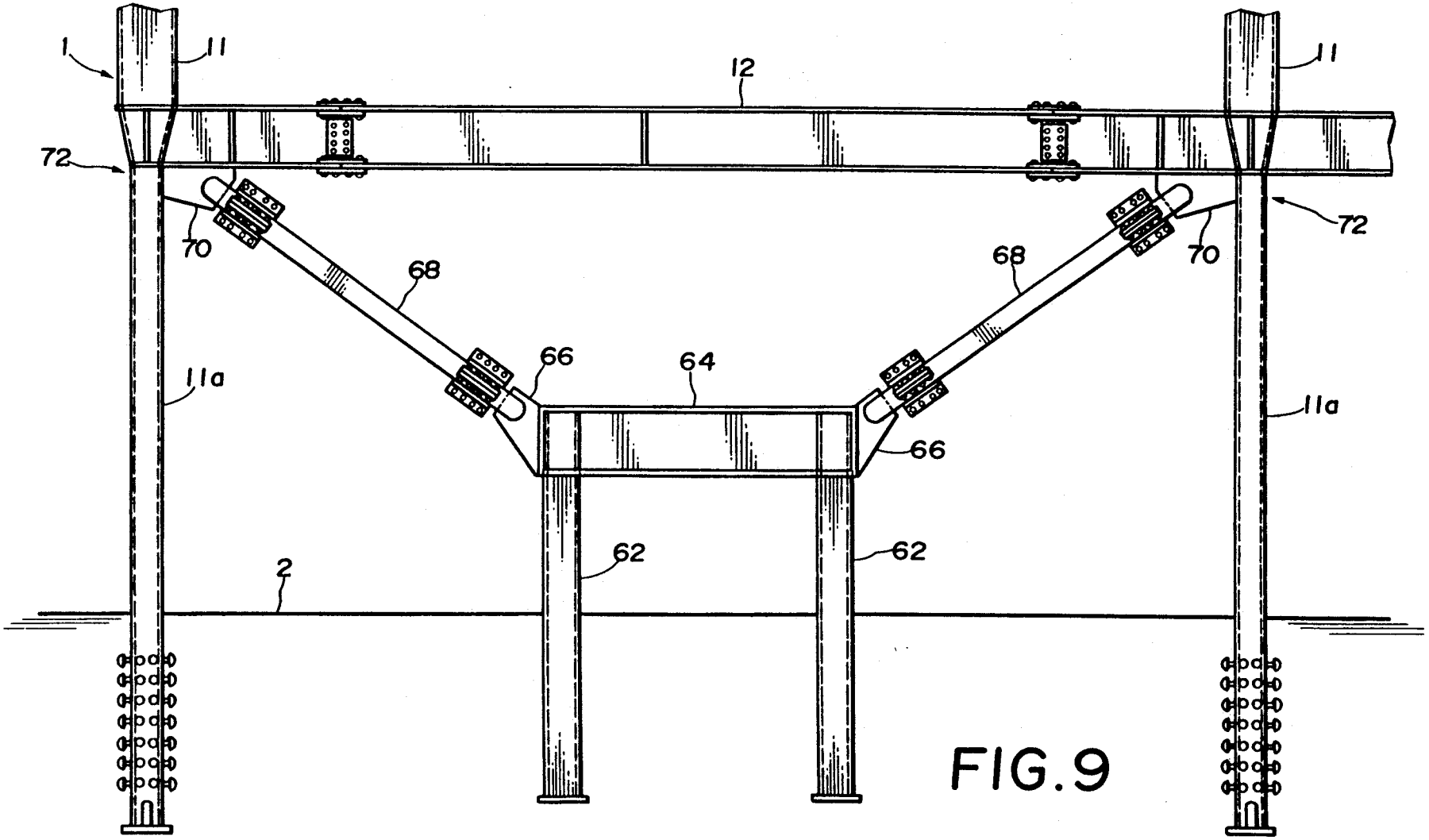
FIGS. 9 and 10 show detail of different embodiments both of which are suitable to be employed in the framework shown in FIG. 8.

FIGS. 8 and 9 illustrate another embodiment of this invention, which embodiment is distinct from the earthquake resistant structure in FIGS. 4 and 5 in that it has a brace structure 60 provided in the first story of the building. The brace structure 60 includes plural pairs of parallel square tubes 62, as the plastic deformation members, of an equal length. The tubes 62 are made of ordinary steel and erected on the foundation 2. The upper ends of each pair of tubes 62 are joined through a horizontal H-section steel connecting member 64. The opposite ends of each connecting member 64 each have a bracket 66 welded to them. An ordinary steel or high strength steel tube brace 68 is attached at one end to each bracket 66 and at the other end to a corresponding gusset plate 70 provided at a joined portion 72 of both of one column 11*a* and the beam 12 of the first story.

The steel tubes 62 are adapted to yield under the severest scale of an earthquake which is expected to occur during the life thereof. The steel tubes 62 are of a short column type and hence have a relatively small slenderness ratio, ratio of the effective length per effective thickness, which prevents degradation of strength due to lateral or shear buckling. It is possible to restrain torsion or local deformation by designing the steel tubes 62 to have a relatively small width-thickness ratio. With such a design, plastic deformability of the steel tubes 62 is enhanced.

Each element of the building with the brace structure 60 behaves within an elastic region of its hysteresis characteristic when the building is subjected to an earthquake of a magnitude which is expected to occur several times during the life thereof. When the building is subjected to the largest scale of an earthquake which is expected to occur during the building life, energy of the external force is transmitted through the braces 68 to the steel tubes 62, the plastic deformation elements, which thus yield. Thus, the brace structure 60 provides energy absorption effect without increasing the strength of the braces 68.

When a horizontal force due to an earthquake is applied to the brace structure 60, a shearing force applied to one connecting member 64 cancels a vertical component of an axial force applied to each of corresponding braces 68. Thus, axial force applied to each plastic deformation members 62 becomes almost negligibly small. Appropriate selection of rigidity of the connecting member 64 makes the moment distribution in each plastic deformation members 62 uniform as possible, as that energy absorption capacity of the plastic deformation members 62 is enhanced.

Figure 10:
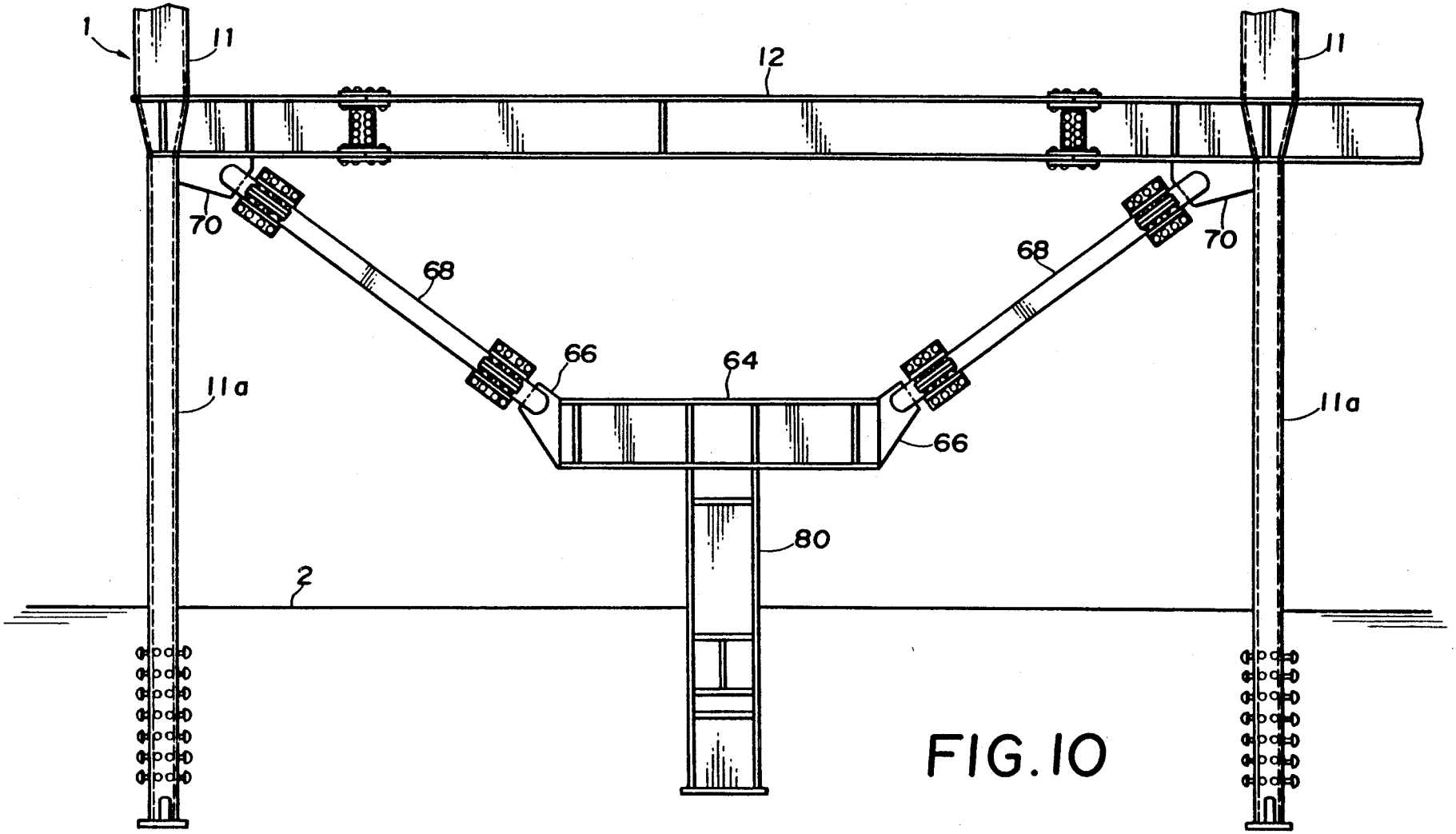

A modified form of the brace structure 60 in FIG. 8 in illustrated in FIG. 10, in which only one I section steel short column 80 as the plastic deformation member is erected at the intermediate position between two adjacent columns 11 and 11. The connecting member 64 is welded at its center portion to the top end of the short column 80.

FIGS. 11A to 11J depict variations of the brace structure 60 in FIGS. 8, in which pin joints are indicated by the reference numeral 82.

Figure 11A:
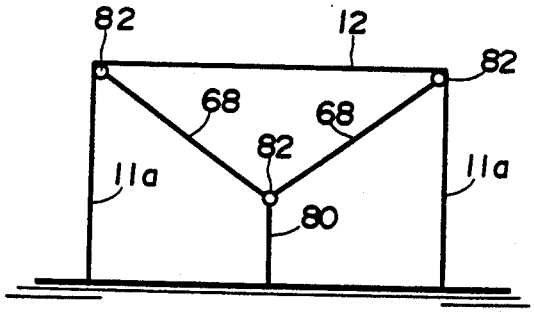
FIGS. 11A through 11J depicts schematically various geometrical features of the elastic deformation members and the plastic deformation members.

In FIG. 11A, the upper end of the short column 80 is directly connected to the braces 68.

Figure 11B:
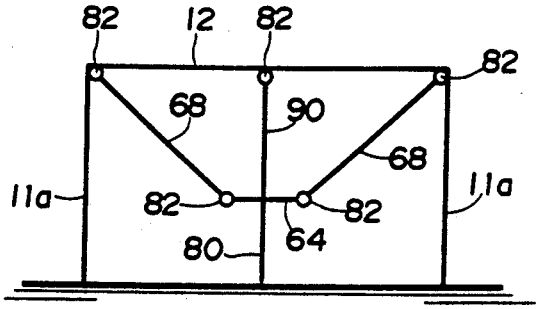

The brace structure in FIG. 11B has another H-section steel connecting member 90 for connecting member 64 to the beam 12. The connecting member 90 is joined at its lower end to the beam 12. The connecting member 64 and at its upper end to the beam 12. The member 90 prevents shear buckling, that is, buckling in a direction perpendicular to the surface of FIG. 11B, of the short column 80.

Figure 11C:
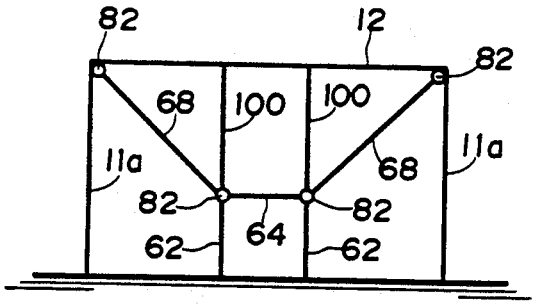

The brace structure in FIG. 11C has a pair of parallel connecting members 100 and 100 welded at their upper ends to the beam 12 and pin joined at their lower ends to respective ends of the connecting member 64.

Figure 11D:
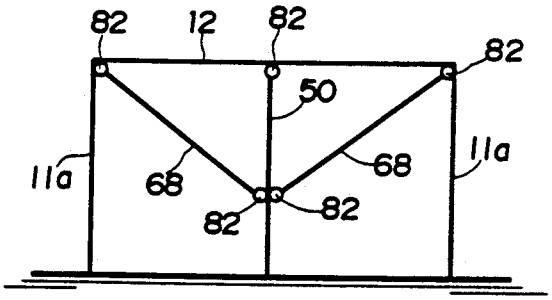

In FIG. 11D, a stud 50 is used instead of the short column 80. The stud 50 is pin joined at its upper end to the beam 12 and at its intermediate portion to the braces 68 and 68.

Figure 11E:
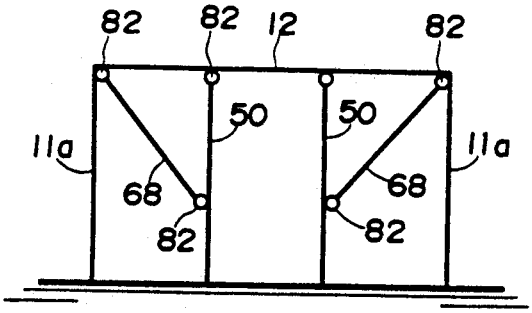

In FIG. 11E, there are provided a pair of parallel studs 50 and 50 with each stud 50 having equal spacing from its adjacent column 11.

Figure 11F:
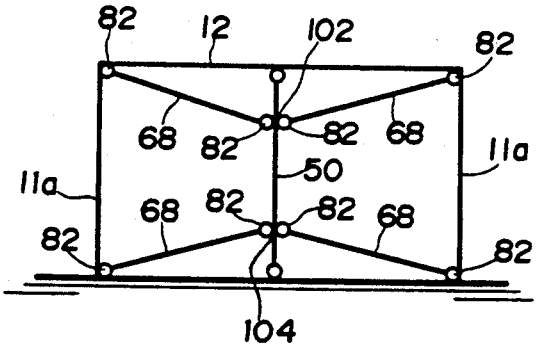

The single stud 50 in FIG. 11F is pin connected at an upper position 102 to a pair of braces 68 and 68 and at a lower position 104, symmetric to the upper position 102, to one ends of another pair of braces 68 and 68, of which the other ends are pin joined to gusset plated (not shown) mounted to lower end of the columns 11*a* and 11*a*.

Figure 11G:
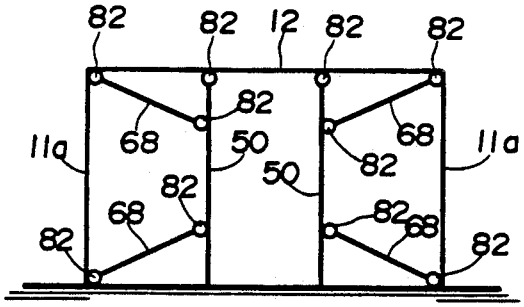

A modified form of the brace structure in FIG. 11F is illustrated in FIG. 11G, in which a pair of studs 50 and 50 are provided.

Figure 11H:
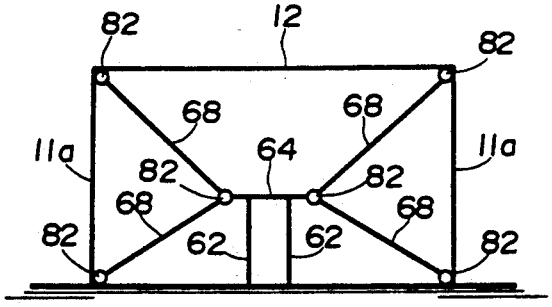

In FIG. 11H, opposite ends of the horizontal connecting member 64 are also pin joined through another pair of braces 68 and 68 to respective gusset plates (not shown) of lower ends of columns 11*a* and 11*a*.

Figure 11I:
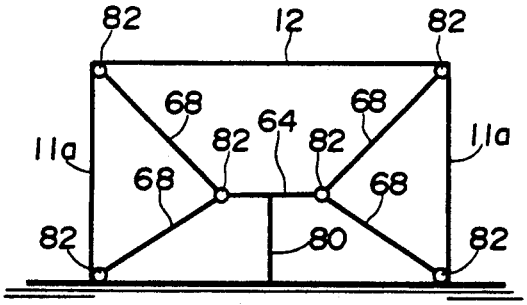

A modified form of the brace structure in FIG. 10 is illustrated in FIG. 11I, in which opposite ends of the connecting member 64 are pin joint through another pair of braces 68 and 68 to respective gusset plates (not shown) of lower ends of columns 11*a* and 11*a*.

Figure 11J:
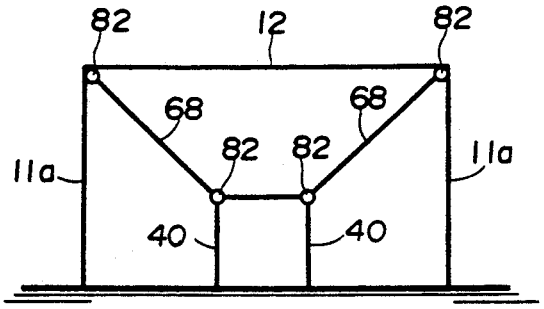

A further modified form of the brace structure in FIG. 8 is illustrated in FIG. 11J, in which a steel panel 40 as the plastic deformation member is provided instead of both the steel tubes 62 and 62 and the connecting member 68. The steel panel 40 is pin joined at its upper corners to respective braces 68 and 68.

In this invention, the brace structure is not restricted in either material or cross-sectional shape to that of the preceding embodiment, and may by provided to many of the stories of the building or a plurality of stories.

Figure 12:
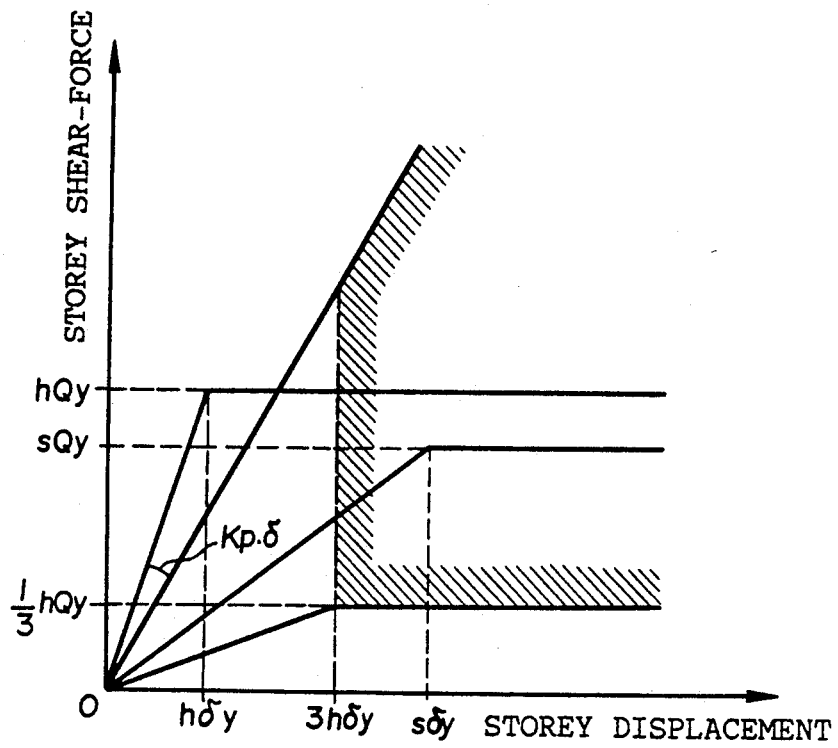
FIG. 12 shows an elasto-plastic force-displacement relationship.
Figure 13:
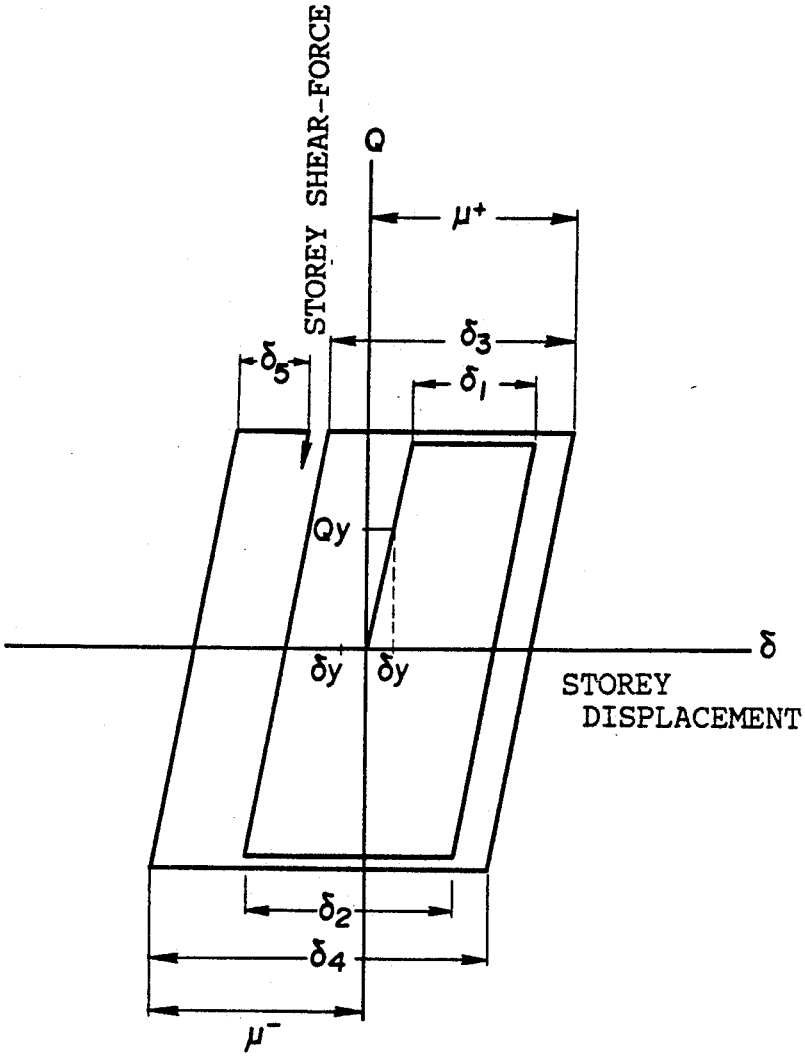
FIG. 13 shows hysteretic features of a force-displacement relationship.

Preferably, combinations of physical properties of elastic deformation members 11*a* and 14, and plastic deformation member 15, 40, 50, 62 and 80 of the preceding em embodiments may be adopted according to the following formulas:

$$sQy/hQy > \tfrac{1}{3}$$

$$s\delta y/h\delta y > 3.0$$

$$hu/hn > 0.35$$

where: hQy is the total sum of yield-shear force of the plastic deformation members; sQy the total sum of yield-shear force of the elastic deformation members; hδy yield deformation of plastic deformation members; sδy yield deformation of elastic deformation members; hμ mean value of apparent maximum inelastic deformation ratio; and hη mean value of cumulative inelastic deformation ratio. More specifically, hu and hn of plastic deformation members are defined below by using factors illustrated in FIG. 13.

$$H\mu = (\mu^+ + \mu^-)/2$$

$$h\eta = (\eta^+ + \eta^-)/2$$

where $\eta^+ = (\delta 1 + \delta 3 + \delta 5)/\delta y$ and $\eta = (\delta 2 + \delta 4)/\delta y$. The character oy designates yield strain of plastic deformation members. In FIG. 12, in which the line Kp.o indicates a shear-force sOy and the yield deformation soy of elastic members may be within the hatched region. The size of each of both the elastic and plastic members is determined irrespective of the floor height and the column span of the building. The above physical values of the plastic and elastic deformation members may be easily obtained by changing the number of structure planes, length and cross-sectional area thereof.

Although the plastic deformation members are adapted to yield when subjected to the severest earthquake, they may hold in elastic region under an earthquake of a relatively small magnitude. It is an option to what magnitude of earthquake plastic deformation members are adapted to yield.

This invention may be applied to reinforced concrete structures, steel framed reinforced concrete structures or similar structures.

Figure 17:
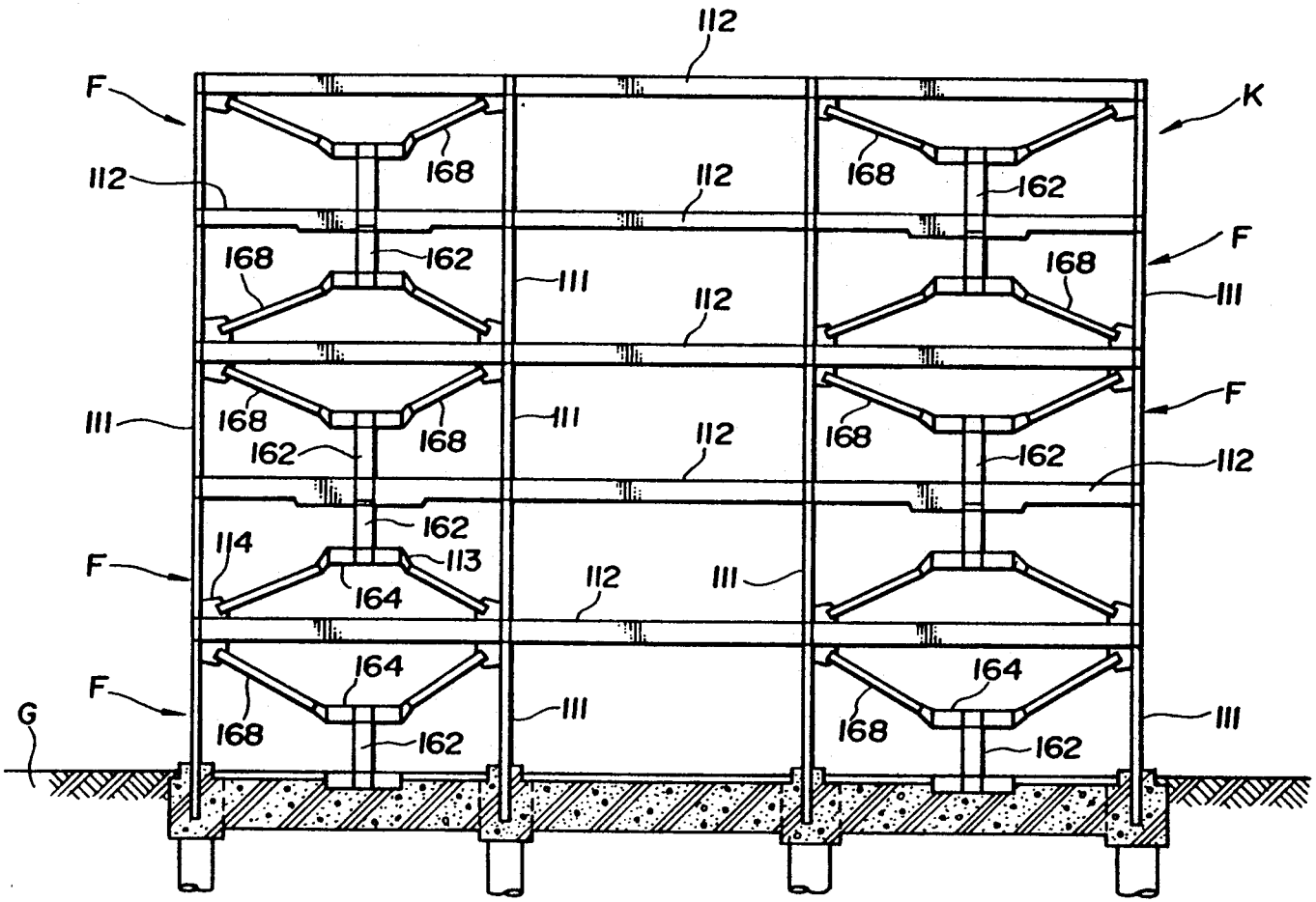
FIG. 17 shows a framework according to an embodiment of the present invention.

FIG. 17 shows an embodiment wherein all the floors are energy concentration floors. According to the embodiment, the plastic deformation members 162 are supported by basement beams of which the depth is larger in the vicinity of the junction with the plastic deformation members 162 compared to other portions. A thick bar member 164 is attached at the top of the plastic deformation members 162. Braces 168 are connecting both ends of the bar members 164 and corners of the framework. The portion of the basement beam wherein the depth is enlarged, contributes to concentrate the plastic deformation to the plastic deformation member 162. The plastic deformation members 162 can be disposed in an inverted way as shown for the second and fourth stories in FIG. 17. At the second floor for example, the plastic deformation members 162 are suspended from the beams 112 of the story. The bar members 164 are, therefore, attached to the lower end of the plastic deformation members 162 and both ends of the bar members are connected to the lower corner of the framework by brace members, connection members 113 and corner attachments 114. The central portions of the beam member 112 are enlarged in depth in the vicinity of the junction with the plastic deformation members 162 so as to increase the rigidity of the beam and concentrate the plastic deformation to the plastic deformation members 162. At the third story, the plastic deformation members 164 are supported from bottom by the same beam members 112 at which the plastic deformation members of the second story are attached. Configuration of the third floor is generally a mirror image of that of the second story with respect to the beam of the second story. The plastic deformation members of the second story and those of the third story may made of a unitary construction, or connected to the beam member 112 separately from below and from above.

Figure 18:
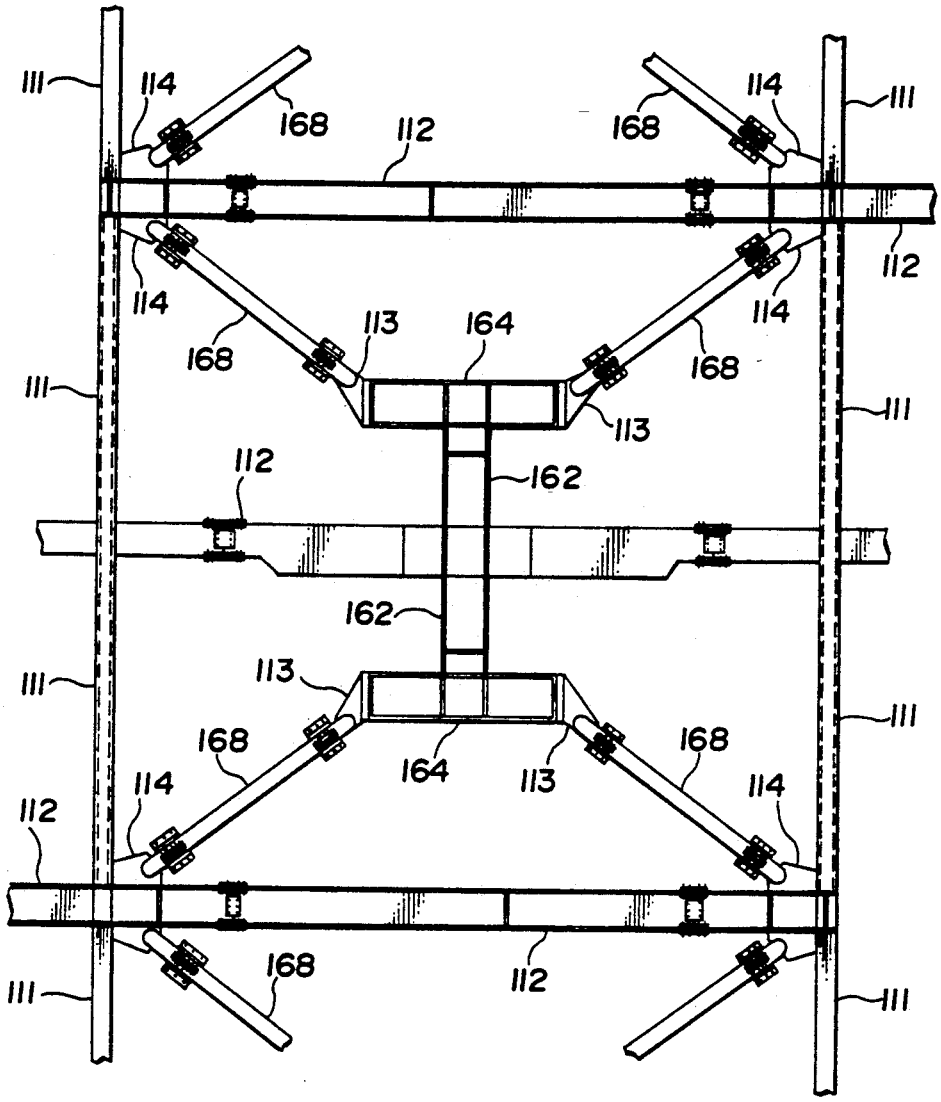
FIG. 18 shows in more detail the first story of an earthquake resistant building shown in FIG. 17.

FIG. 18 shows in more detail the structures including the plastic deformation member 162. The beam member 112 is mainly composed of a pair of distal portions which are connected to the columns 111 and a central portion connecting both the distal portions by connection means 112. The central portions of the beam members which are attached to the plastic deformation members 164 have a depth larger than the distal portions thereof, so as not to enter into the plastic deformation range even when the plastic deformation member is plastified. The plastic deformation member 162 is attached to the beam member at one end thereof, and a bar member 164 is attached to the other end of the plastic deformation member. The bar member 164 may enter into the plastic deformation range together with the plastic deformation member 162, or may remain in the elastic range even when the plastic deformation member 162 enters into the plastic range. Both ends of the bar member 164 are connected to the framework by brace means 168 which are connected to the bar member 164 and the framework via connection members 113 and 114. The plastic deformation member 162 and bar member 164 may be prefabricated before connecting to the beam member 112. A larger portion which includes a pair of plastic deformation members 162, a pair of bar members 164, and a central portion of the beam member 112 can be prefabricated, and connected to the framework afterwards on site.

Figure 19:
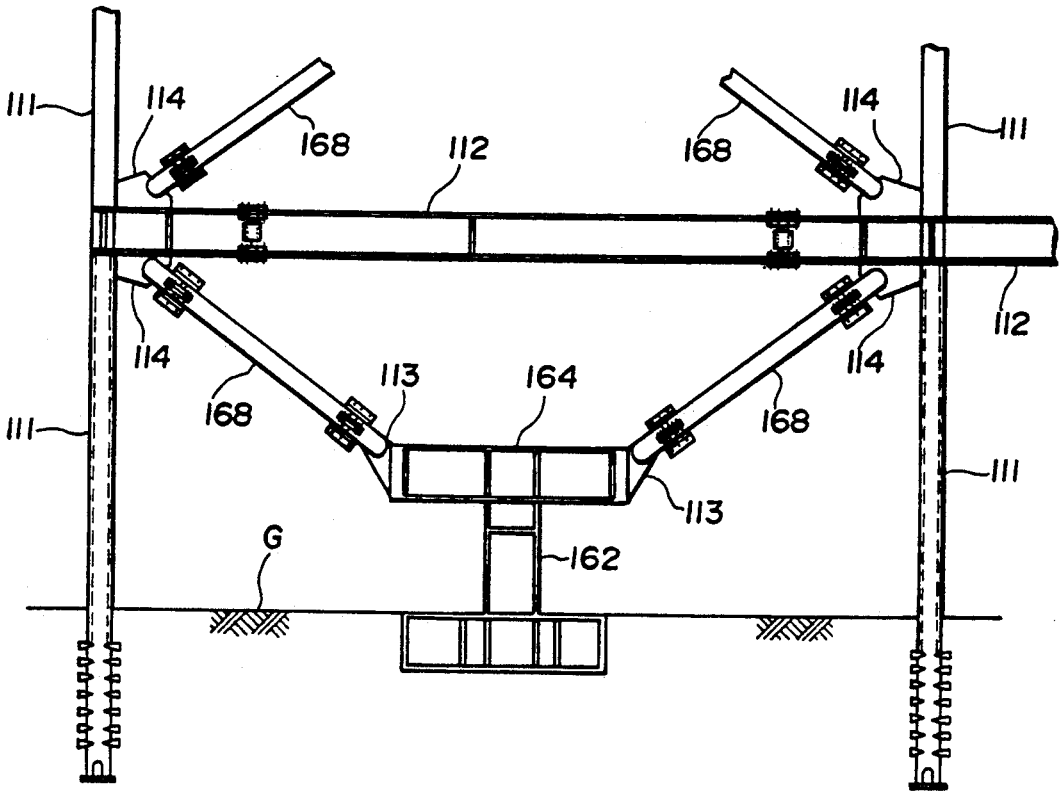
FIG. 19 shows in more detail intermediate stories of an earthquake resistant building shown in FIG. 17.

FIG. 19 shows the first floor of the building. According to the drawing, the plastic deformation member 162 is supported by an anchoring means which is attached to the lower end of the plastic deformation member 162 and embedded into the concrete slab of the first floor.

Figure 20:
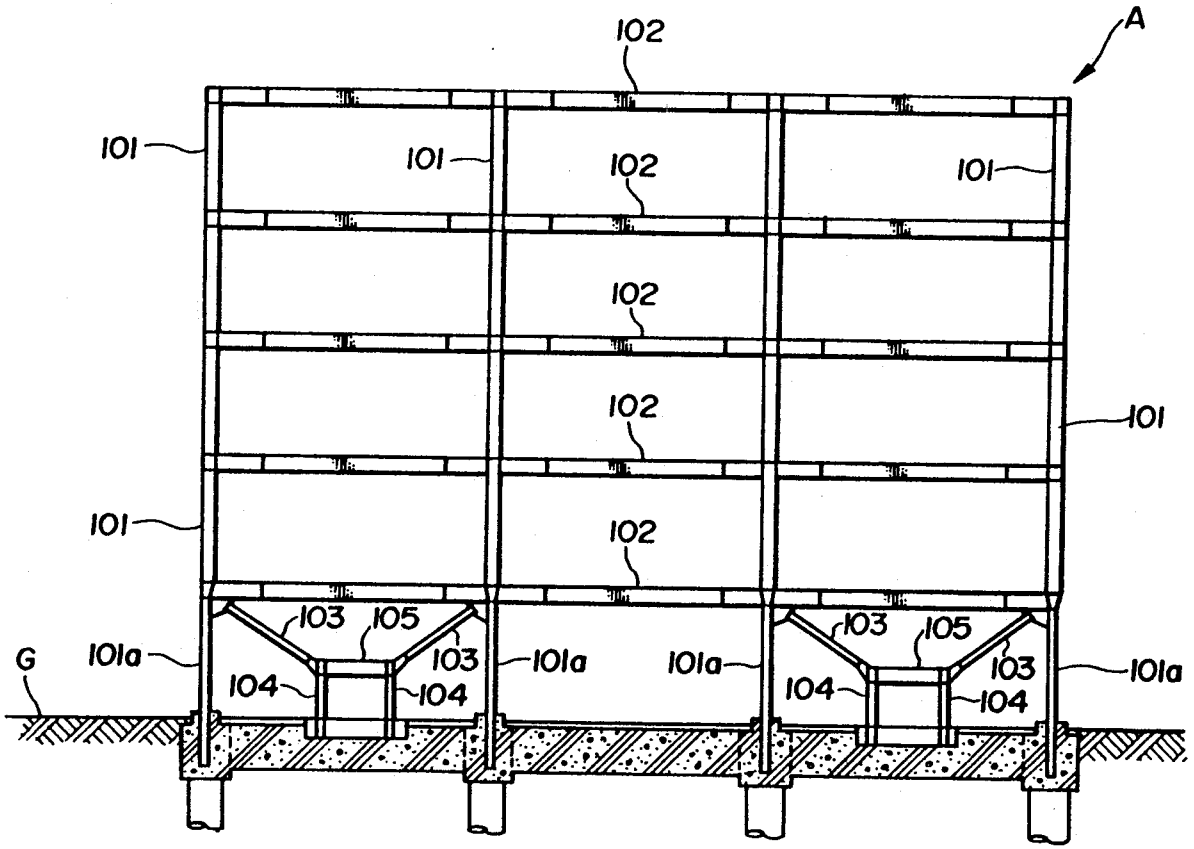
FIG. 20 shows a framework according to an embodiment of the present invention.

FIG. 20 shows another embodiment of the present invention. The embodiment is different from the former embodiment in that the plastic deformation member 104 comprises two columns 104 which are erected in a parallel manner from the basement of the building. The depth of the horizontal bar member 105 is larger than the thickness of the columns so that the plastic deformation is concentrated to the columns 104. The both ends of the horizontal bar member 105 are attached to the corner of the framework by brace members 103. The columns 101*a* of the first story may be more slender than the columns of upper stories because the plastic deformation members 104 resist the horizontal force while they in the elastic deformation range. The plastic deformation members 104 shown in FIG. 20 can also be disposed to other stories as the embodiment shown in FIG. 17.

Figure 21:
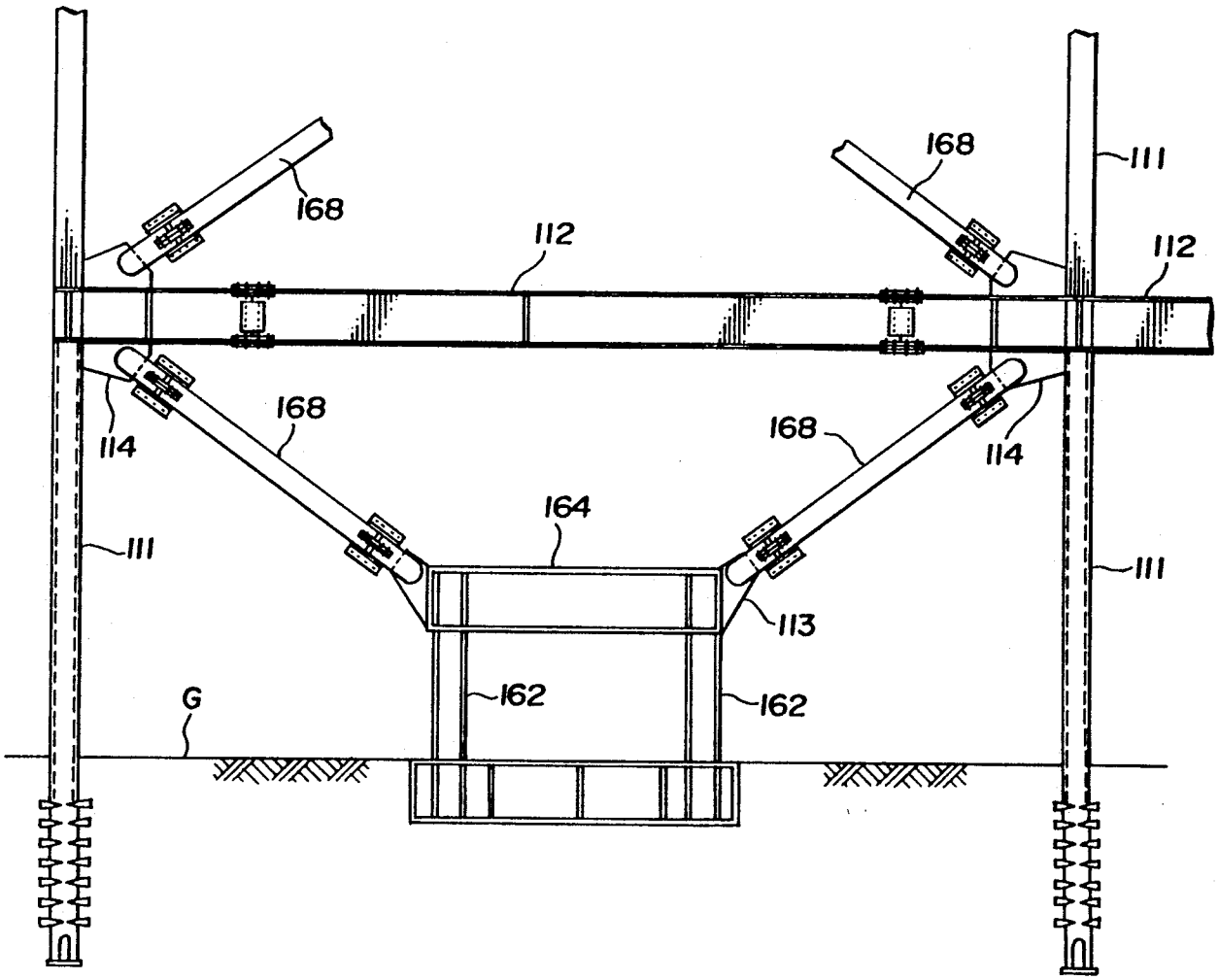
FIG. 21 shows the first story of the building shown in FIG. 20.

FIG. 21 shows in more detail the embodiment shown in FIG. 20. The columns 162 are erected from the basement beam which is embedded in the bas slab.

Figure 22:
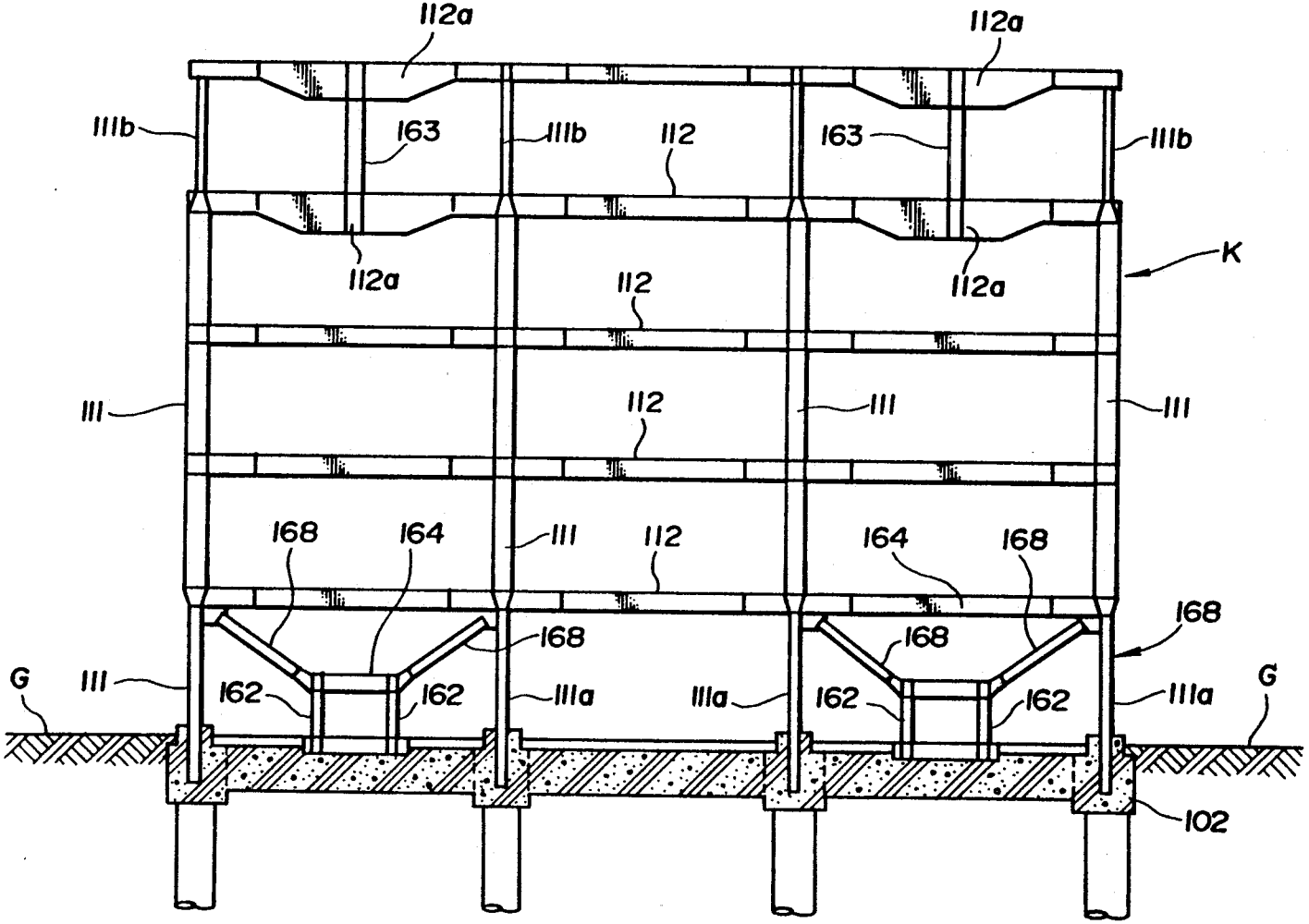
FIG. 22 shows a framework of a building according to an embodiment of the present invention.

FIG. 22 shows another embodiment wherein a more simplified plastic deformation members 163 are provided in the fifth floor. The plastic deformation members 163 are attached to the lower and upper beams of the story at their lower and upper ends. The lower and upper beams have thicker depths in the vicinity of the junctions with the plastic deformation member 163. Because of the enlarged thickness of the upper beams 112*a*, the length of the plastic deformation member 163 is shorter than other ordinary columns 11*b* of the story. The ordinary columns 111*b* are more slender than the plastic deformation members 163. Because of their thicker diameter and shortened length, the plastic deformation member 163 enter into the plastic deformation range prior to the ordinary column 111*b*. After the plastic deformation members 163 enters into the plastic deformation range, the horizontal force of the fifth story is supported by the ordinary columns 111*b*.

Figure 23:
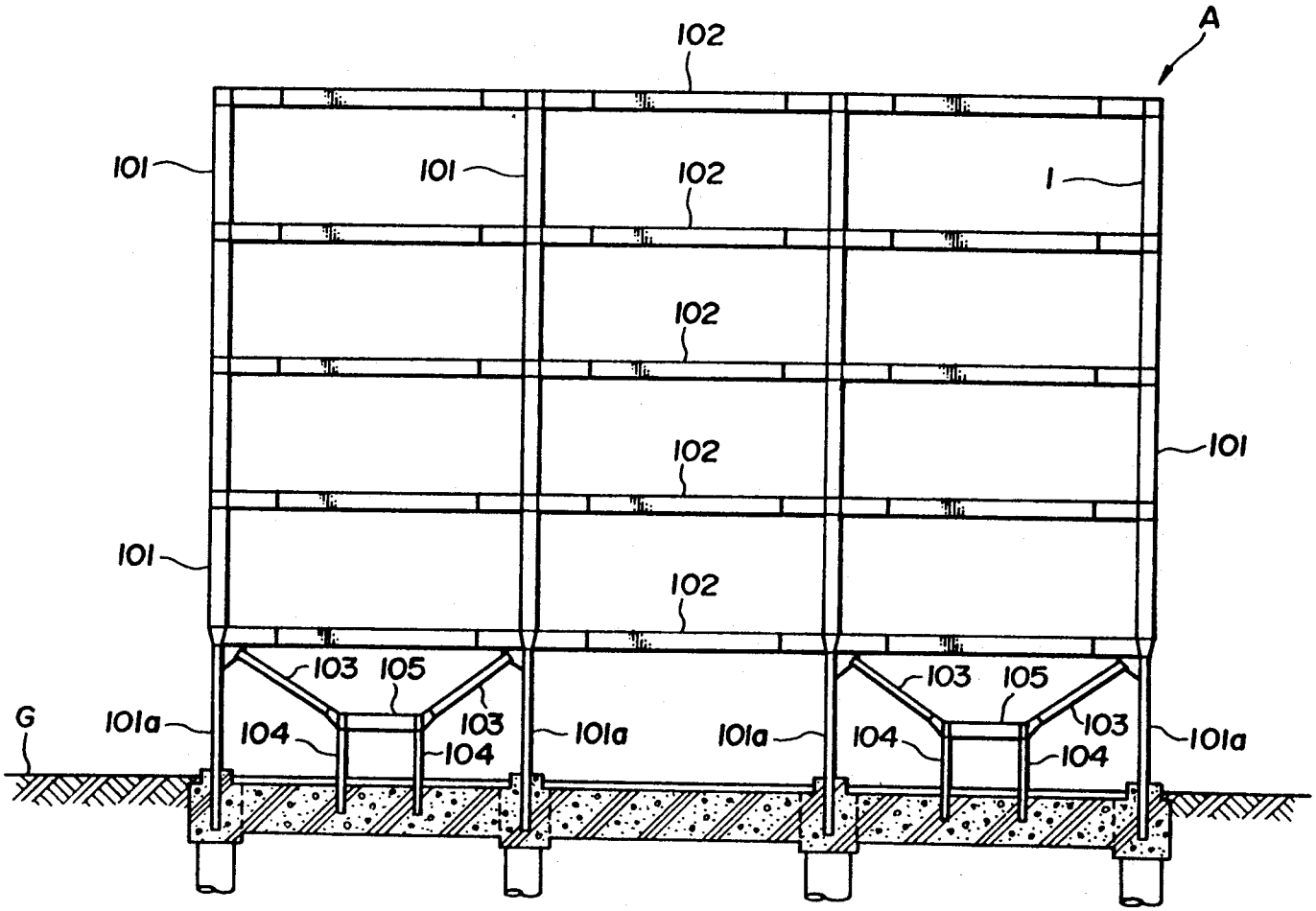
FIG. 23 show a framework of a building according to an embodiment of the present invention.

As shown in FIG. 23, the lower parts of the plastic deformation members may be directly embedded in the base slab through the base beam.

The above explanation was based on the embodiments wherein the force-displacement relationship is elasto-plastic. Although, the relationship is not limited to elasto-plastic relationships, and all the relationships such as those expressed by multi-linear hysteretic model, degrading stiffness multilinear model and slip model can also be utilized as long as they permit relative large plastic deformation and energy consumption ability.

What is claimed is:

1. An earthquake resistant multi-story building comprising at least one energy concentration story having an elasto-plastic force-displacement relationship with respect to horizontal force and displacement;

the force-displacement relationship being substantially specified by a yield strength $F_y$, a yield displacement $\delta_y$, an ultimate strength $F_u$, and an ultimate displacement $\delta_u$;

the energy concentration story comprising:

a) plastic deformation members coupled to a portion of the building above the energy concentration story so that the plastic deformation members exhibit a large resistance to displacement when the displacement of that portion of the building is small, but when displacement is large, the plastic deformation members enter the plastic range; and b) elastic deformation members having elastic deformability up to the ultimate displacement, the elastic deformation members being capable of supporting the weight of that portion of the building above the energy concentration story, and being coupled to that portion of the building; and the force-displacement relationship of the energy concentration story being characterized in that:

(a) stiffness in elastic range ($F_y/d_y$) is substantially greater than the stiffness in the plastic range;

(b) the ultimate strength $F_u$ is between 0.5 and 0.8 times the optimum strength;

(c) the ultimate strength $F_u$ is not smaller than the yield strength $F_y$; and (d) the ultimate displacement is substantially at least eight times as large as the yield displacement;

whereby the plastic deformation members of the energy concentration story are capable of entering into the plastic range while other stories are in the elastic range so as to absorb vibration energy by plastic deformation of said plastic deformation members and decrease deformations of other stories when a large external force is exerted on the building.

2. An earthquake resistance multi-story building according to claim 1 wherein the yield strength $F_y$ is between 20% and 60% of the optimum yield strength.

3. An earthquake resistant multi-story building according to claim 1 wherein the yield strength $F_y$ of the energy concentration story is greater than an expected maxim horizontal force against medium design earthquake.

4. An earthquake resistant multi-story building according to claim 1 wherein the energy concentration story is the first story.

5. An earthquake resistant multi-story building according to claim 1 which comprises a plurality of energy concentration stories.

6. An earthquake resistant multi-story building according to claim 5 wherein the energy concentration stories are the first story and the top story.

7. An earthquake resistant multi-story building according to claim 5 wherein all the stories of the building are energy concentration stories.

8. An earthquake resistant multi-story building according to claim 1 wherein the elastic deformation members are columns of the building for supporting gravitational loads, and the plastic deformation members are not supporting the gravitational loads.

9. An earthquake resistant multi-story building according to claim 1 wherein the plastic deformation members are connected to beams of the story and the beams are enlarged in depth in the vicinity of the connection with the plastic deformation members.

10. An earthquake resistant multi-story building according to claim 1 which is further provided with a restoring means which are not in contact with the column while horizontal deformation of the story is less than a predetermined value and comes in contact with the columns when the horizontal displacement exceeds the predetermined level whereby providing additional restoring force to the story sufficient to cancel p-$\delta$ effect.

11. An earthquake resistant multi-story building according to claim 1 wherein the energy concentration story has a multi-linear hysteretic force displacement relationship.

12. An earthquake resistant multi-story building according to claim 1 wherein the energy concentration story has a bi-linear hysteretic force-displacement relationship.

13. An earthquake resistant multi-story building comprising at least one energy concentration story comprising:

(a) elastic deformation members having an elastic deformability up to an ultimate displacement;

(b) plastic deformation members having a yield displacement substantially equal to a yield displacement of the energy concentration story, and a plastic deformability up to the ultimate displacement, and being coupled to that portion of the building above the concentration story, so that the plastic deformation members exhibit a large resistance to displacement when the displacement of that portion of the building is small, but when displacement is large, the plastic deformation members enter the plastic range;

the energy concentration story having an elasto-plastic force-displacement relationship regarding horizontal force and displacement, the force-displacement relationship being substantially specified by a yield strength $F_y$, a yield displacement $\delta_y$, an ultimate strength $F_u$, and an ultimate displacement $\delta_u$;

the force-displacement relationship being characterized in that:

(i) stiffness in elastic range ($F_y/d_y$) is substantially greater than the stiffness in the plastic range;

(ii) the ultimate strength $F_u$ is between 0.5 and 0.8 times the optimum strength;

iii) the ultimate strength $F_u$ is not smaller than the yield strength $F_y$; and (iv) the ultimate displacement is substantially at least eight times as large as the yield displacement;

whereby the energy concentration story is capable of entering into the plastic range while other stories are in the elastic range, and absorbing vibration energy by plastic deformation of said plastic deformation members so as to decrease deformations of other stories when a large external force is exerted on the building.

* * * * *

UNITED STATES PATENT AND TRADEMARK OFFICE

CERTIFICATE OF CORRECTION

PATENT NO. : 5,271,197

DATED : December 21, 1993

INVENTOR(S) : UNO ET AL

It is certified that error appears in the above-identified patent and that said Letters Patent is hereby corrected as shown below:

On the Title Page, under "Related U.S. Application Data" "Aug. 6, 1990" should be --Jun. 25, 1990-- and "Ser. No. 07/376,922" should be --Ser. No. 07/376,927--.

In Column 1, line 6, "Aug. 6, 1990" should be --Jun. 25, 1990-- and in line 8, "07/376,922" should be --07/376,927--.

Signed and Sealed this

Thirty-first Day of May, 1994

*Attest:*

Bruce Lehman

BRUCE LEHMAN

*Attesting Officer*

*Commissioner of Patents and Trademarks*